US008596362B2

(12) United States Patent
Nelson

(10) Patent No.: US 8,596,362 B2
(45) Date of Patent: Dec. 3, 2013

(54) HYDRAULIC FRACTURING METHODS AND WELL CASING PLUGS

(75) Inventor: Scott Gregory Nelson, Edmond, OK (US)

(73) Assignee: Baker Hughes Incorporated, Houston, TX (US)

( * ) Notice: Subject to any disclaimer, the term of this patent is extended or adjusted under 35 U.S.C. 154(b) by 333 days.

(21) Appl. No.: 13/111,585

(22) Filed: May 19, 2011

(65) Prior Publication Data

US 2012/0292031 A1 Nov. 22, 2012

(51) Int. Cl.
*E21B 33/13* (2006.01)
*E21B 43/267* (2006.01)

(52) U.S. Cl.
USPC ..... 166/281; 166/192; 166/280.1; 166/283; 166/298

(58) Field of Classification Search
None
See application file for complete search history.

(56) References Cited

U.S. PATENT DOCUMENTS

| | | | | |
|---|---|---|---|---|
| 7,735,556 | B2 | 6/2010 | Misselbrook et al. | |
| 7,870,902 | B2 | 1/2011 | Misselbrook et al. | |
| 2006/0283592 | A1 * | 12/2006 | Sierra et al. | 166/281 |
| 2010/0212906 | A1 * | 8/2010 | Fulton et al. | 166/308.5 |

OTHER PUBLICATIONS

BJ Services Company, LitePlug Isolation System, Reliable, low-risk multizone isolation, dated Nov. 2009, 2 pages.
BJ Services Company, News Release, BJ Services Celebrates 300th Field Application of LitePlug Zone Isolation System in Canada, Consolidated Sand Plug Technology Speeds Horizontal Multizone Fracturing, dated Mar. 11, 2009, 2 pages.
Nelson, Scott, BJ Services Company, LitePlug technology saves damaged wells, BJ Techline, non-dated, p. 7.

* cited by examiner

*Primary Examiner* — Zakiya W Bates
(74) *Attorney, Agent, or Firm* — Parsons Behle & Latimer

(57) ABSTRACT

A hydraulic fracturing method includes injecting a fluid containing a transitory binder and filler into a substantially horizontal well casing without any placement apparatus present in the substantially horizontal well casing, the filler containing particles of a solid material. The transitory binder and filler are placed over first perforations in the well casing. The method includes opening second perforations through the well casing, injecting additional fracturing fluid through the substantially horizontal well casing, and forming a plug over and through the first perforations with the transitory binder and filler.

22 Claims, 3 Drawing Sheets

HYDRAULIC FRACTURING METHODS AND WELL CASING PLUGS

BACKGROUND

The embodiments described herein relate generally to hydraulic fracturing methods and well casing plugs.

Fracture stimulation, a known practice in the oil and gas industry, may be used to increase the production of hydrocarbons from wells, such as in lower quality reserves. Known practices include forming a well bore in a subterranean formation and inserting a well casing in the well bore. Horizontal well bores may be formed to increase the extent to which a single well bore may reach desired regions of a formation. Horizontal wells as a percentage of newly drilled wells continue to rise. Multiple fracture stages may be implemented in a single well bore to increase production levels and provide effective drainage. Perforations in sections of a well casing allow fracturing fluid at high pressure to initiate and then propagate a fracture in the formation during each stage. A proppant included in the fracturing fluid may lodge in the fracture to keep it propped open after fracturing, increasing conductivity. For effective fracturing, one section may be fractured at a time by hydraulically isolating other perforated sections. Inserting a mechanical isolation plug, sometimes called a bridge plug, may selectively isolate sections not intended for fracturing.

Placing of bridge plugs in a horizontal well casing may involve increased manipulation and time in comparison to a vertical well casing. Consequently, so-called "sand plugs" have been used to reduce time and costs for horizontal well casing. A sand plug may be formed by using a placement apparatus, such as coiled tubing or a jointed pipe string, to position an elevated concentration of sand and/or proppant provided at the end of the fracturing fluid. The high concentration of sand and/or proppant screens out against the fractures and begins to bridge off. The sand continues to bridge off against the perforations in the well casing and, eventually, bridges of against itself, creating a sand plug. A rise in pressure indicates that a proper sand plug has been formed within the well casing.

However, forming a sand plug within a horizontal well casing may present challenges due to the variety of circumstances encountered in fracture stimulation processes. Accordingly, further advancement in methods and materials for forming sand plugs may be of benefit.

Figure 1:
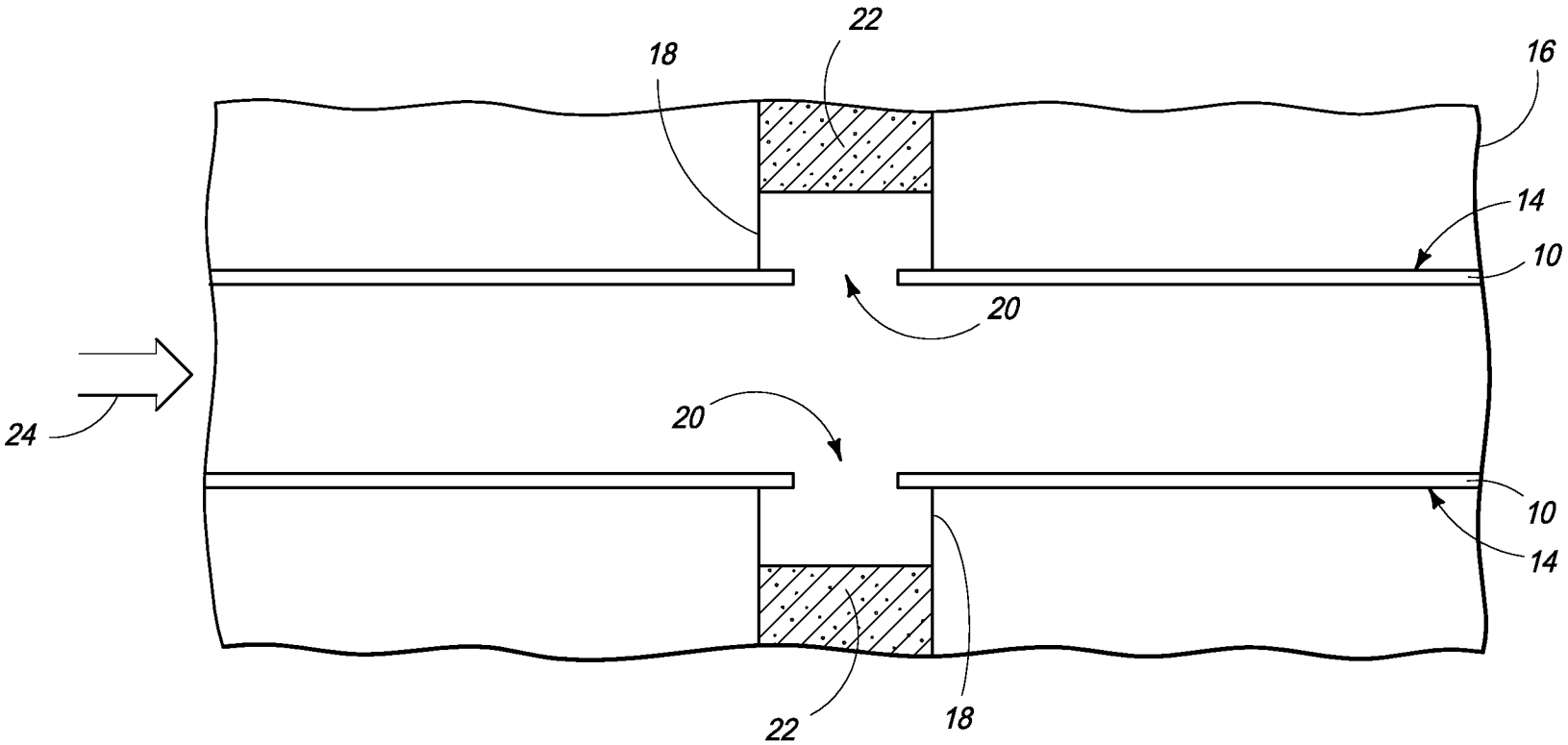
FIGS. 1-3 are cross-sectional, schematic views of a portion of a length of well casing at different stages in a process of forming a plug according to one embodiment.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

Although mechanical isolation plugs are commonly used, circumstances involving drastic deviations in well bore direction or shifting formations that collapse well casing may be incompatible with use of mechanical isolation plugs. A high angle bend in the well casing or a reduction in the well casing internal diameter may prevent mechanical isolation plugs from being set into position. U.S. Pat. No. 7,735,556 issued Jun. 15, 2010 to Misselbrook et al, describes methods for building a plug in a horizontal well bore using ultra lightweight proppant, U.S. Pat. No. 7,870,902 issued Jan. 18, 2011 to Misselbrook et al. describes methods for fracturing a subterranean formation, including placing plugs containing proppant material in a well bore. Such methods provide known alternatives to using mechanical plugs and have demonstrated increased speed and flexibility along with lower-risk compared to mechanical isolation technologies. Misselbrook '556 and Misselbrook '902 listed above are incorporated herein by reference for their pertinent and supportive teachings related the general technology of using sand plugs for isolation in fracture stimulation processes.

In an embodiment, a hydraulic fracturing method includes injecting fracturing fluid containing proppant through a substantially horizontal well casing positioned in a well bore, the substantially horizontal well casing having first perforations through the well casing to a subterranean formation adjacent the well bore. The term "well casing" is used broadly herein to encompass all types of barriers or liners, whether permanent or temporary, formed or inserted in well bores to isolate the formation from the well bore, including coatings such as described in Misselbrook '902. Also, while "horizontal" well bores in a formation to be fractured generally are close to true horizontal, some deviation from true horizontal may occur. Embodiments herein are intended for application to a variety of circumstances, such as high angle bends. Accordingly, the embodiments encompass substantially horizontal well casing, meaning within 45° of horizontal.

The formation is hydraulically fractured through the first perforations using the fracturing fluid and the proppant lodges in fractures in the formation produced by the hydraulic fracturing. After the fracturing, the method includes providing transitory binder and filler in a liquid carrier, the filler containing particles of a solid material. The proppant and the filler may have a same composition. The liquid carrier may be the fracturing fluid or a different composition of fluid. Any known proppant suitable for hydraulic fracturing may be used as the proppant in the embodiments herein and, accordingly, as the filler too. Instead, other materials may be used for the filler that exhibit properties consistent with the implementation of the filler described herein, but which might be less desirable for use as a proppant. The filler may comprise multiple materials, such as the proppant and other materials.

The fracturing fluid containing the transitory binder and filler is injected into the substantially horizontal well casing without any placement apparatus present in the substantially horizontal well casing. Examples of placement apparatuses are coiled tubing, a jointed pipe string, and a wireline. A placement apparatus serves the function of aligning injection of a substance into a well at a desired position, for example, at perforations through the well casing. Coiled tubing may be used to place devices that form perforations in well casing, clean out injected materials after hydraulic fracturing, inject sand plug materials, etc. Despite the absence of placement apparatuses in the substantially horizontal well casing of the embodiments herein, the method includes placing the transitory binder and the filler over the first perforations. Possible techniques for placement are described below.

Injection of the fracturing fluid containing proppant may also occur without any placement apparatus present in the substantially horizontal well casing. Further, hydraulically fracturing the formation through the first perforations using the fracturing fluid may occur without any placement apparatus present in the substantially horizontal well casing. Instead, fracturing fluid and proppant may be injected into the well casing after removal of the placement apparatus from the substantially horizontal well casing. The placement apparatus may be removed from the well bore altogether or merely removed from the substantially horizontal well casing to a vertical section of well casing.

A number of benefits may be obtained from injecting the liquid carrier containing the transitory binder and filler without any placement apparatus present in the substantially horizontal well casing. First, since coiled tubing and a jointed pipe string have a smaller diameter than the well casing, pumping the liquid carrier, transitory binder, and filter through the well casing may occur at a higher flow rate than through the placement apparatus. For a 5.5 inch outside diameter (OD) well casing with coiled tubing removed, flow rate may be as much as 20 to 50 times higher than flow rate through known diameters of coiled tubing. Although known methods use coiled tubing to place sand plugs with significant accuracy, the lower flow rate through coiled tubing increases the time for forming the plugs compared to the embodiments described herein. Use of coiled tubing thus slows down preparation for each fracture stage. As a first benefit, embodiments described herein allow higher flow rate, reducing the time to place a plug, and still provide accurate plug placement.

Even if the liquid carrier, transitory binder, and filler are pumped through the annulus between the well casing and placement apparatus, the friction pressure may increase due to the presence of the placement apparatus. The placement apparatus may thus reduce the effective diameter of the well casing. That is, a 5.5 inch OD well casing with a placement apparatus installed might exhibit pumping limitations like those of a smaller OD well casing without a placement apparatus installed. The resistance of fluids to movement through the well casing generates friction pressure. Normally, friction pressure depends on the rheological behavior of fluids when exposed to shear during pumping. Due to a similar interaction, placement apparatus in a well casing may additionally influence friction pressure.

Most well casing is assigned a pressure rating. Flow rate of a particular material through well casing may be limited by the pressure the well casing can withstand, as designated by the pressure rating, without rupturing the well casing. The increase in friction pressure caused by placement apparatus may limit the flow rate of liquid carrier, transitory binder, and fitter through the annulus and thus slow down plug placement to avoid over-pressuring the well casing compared to an acceptable flow rate without placement apparatus. As a second benefit, embodiments described herein allow higher flow rate, reducing the time to place a plug.

In known methods with the placement apparatus in the well casing, coiled tubing or a jointed pipe string might be pressurized to reduce damage to the coiled tubing during fracturing. Placement apparatus may instead be pulled out of the well casing to be certain it is not damaged. Placement apparatus removal reduces complexity of the fracturing since flow rate and/or pressure in placement apparatus need not be monitored. Although legitimate reasons exist for putting out placement apparatus after positioning a sand plug, the added measure may be time consuming. As a third benefit, time to prepare for a fracture stage is reduced if no placement apparatus is used to position a plug since no delay occurs while pulling out the placement apparatus.

The process flow for known fracturing methods may be as follows: place plug over perforations using placement apparatus, pull out placement apparatus, fracture, insert placement apparatus having a tool to open next stage perforations (such as, perforating "guns"), open next perforations, pull out placement apparatus and remove perforating tool, insert placement apparatus, and place next plug. For embodiments herein that inject liquid carrier, transitory binder, and filler without placement apparatus, a perforating tool, if used, may remain on the placement apparatus without being removed between fracture stages. The ability to leave a perforating tool on the placement apparatus, e.g., coiled tubing, provides a fourth benefit of embodiments herein.

Using a placement apparatus in the present embodiment, second perforations are opened through the well casing to the formation adjacent the well bore. The second perforations are separated from the first perforations. Known methods for opening the second perforations may be used. The present method includes injecting additional fracturing fluid through the substantially horizontal veil casing and forming a plug over and through the first perforations with the transitory binder and filler. After plugging the first perforations, the formation is hydraulically fractured through the second perforations using the additional fracturing fluid. A flow of cleanout fluid is applied to the plug sufficient to disengage the transitory binder and expose the first perforations. The flow may be applied by a jetted stream of cleanout fluid directed to the plug, the stream of fluid entraining the filler and transitory binder of the plug for removal from the substantially horizontal well casing.

The method may include repeating the method multiple times in a manner that forms an additional plug over the second perforations and subsequent plugs over subsequent perforations and that hydraulically fractures the formation through the subsequent perforations before the application of the flow of cleanout fluid. Thereafter, the flow of cleanout fluid may be applied to the plug, the additional plug, and the subsequent plugs sufficient to disengage the transitory binder and expose the first, the second, and the subsequent perforations, as described above for the first plug.

As indicated above, inject on of the fracturing fluid may also occur without any placement apparatus present in the substantially horizontal well easing. Such a measure may provide benefits similar to the benefits listed above that result from injecting the liquid carrier, transitory binder, and Idler without any placement apparatus in the well casing. Namely, such an embodiment reduces friction pressure and allows higher flow rate of the fracturing fluid than through an annulus, reducing the time to fracture a formation.

Accordingly, one example of a process flow for embodiments herein may be as follows: place plug over perforations, fracture, insert placement apparatus having a tool to open next stage perforations (such as, perforating "guns"), open next perforations, pull out placement apparatus and perforating tool, and place next plug. Such a process flow example is noticeably less complex and time consuming compared to the process flow for known fracturing methods described above.

The particles of the solid material comprised by the filler may provide a majority of the mass of the plug. Most known proppants are made of materials having the high density usually associated the level of crush resistance desired for hydraulic fracturing operations. Accordingly, the solid material comprised by the filler, which may be proppant, may have a specific gravity of 2.0 or greater, for example, 2.65 or greater. Advanced, lightweight proppants are also known having lower specific gravities, such as from about 1.05 to about 1.75, and may instead or in addition be used as the filler. Sand suitable for use as a proppant may also be suitable for the filler.

The proppant and the transitory binder may have a different composition. The transitory binder may be a solid, semisolid, including a gel, or a liquid. Even if it is a solid, the transitory binder may comprise particles of a solid material different from the filler. The transitory binder may provide a minority of the mass of the plug and have a specific gravity of less than 2.0. By having a specific gravity near to or less than the specific gravity of the liquid carrier and less than the filler, the transitory binder may inhibit settling of the filler prior to formation of the plug. As the filler in the carrier liquid settles, it becomes less effective in forming a plug.

The transitory binder may function by releasably engaging the filler particles with one another sufficiently for the plug to withstand an applied pressure of hydraulic fracturing without loss of integrity of the plug. The transitory binder may also exhibit the characteristic of allowing the filler particles to disengage into the cleanout fluid, resulting in loss of integrity of the plug. Further, the transitory binder may releasably engage the filler particles with one another without loss of integrity by breaching of the plug even when slippage between particles occurs at the applied pressure of hydraulic fracturing.

Figure 2:
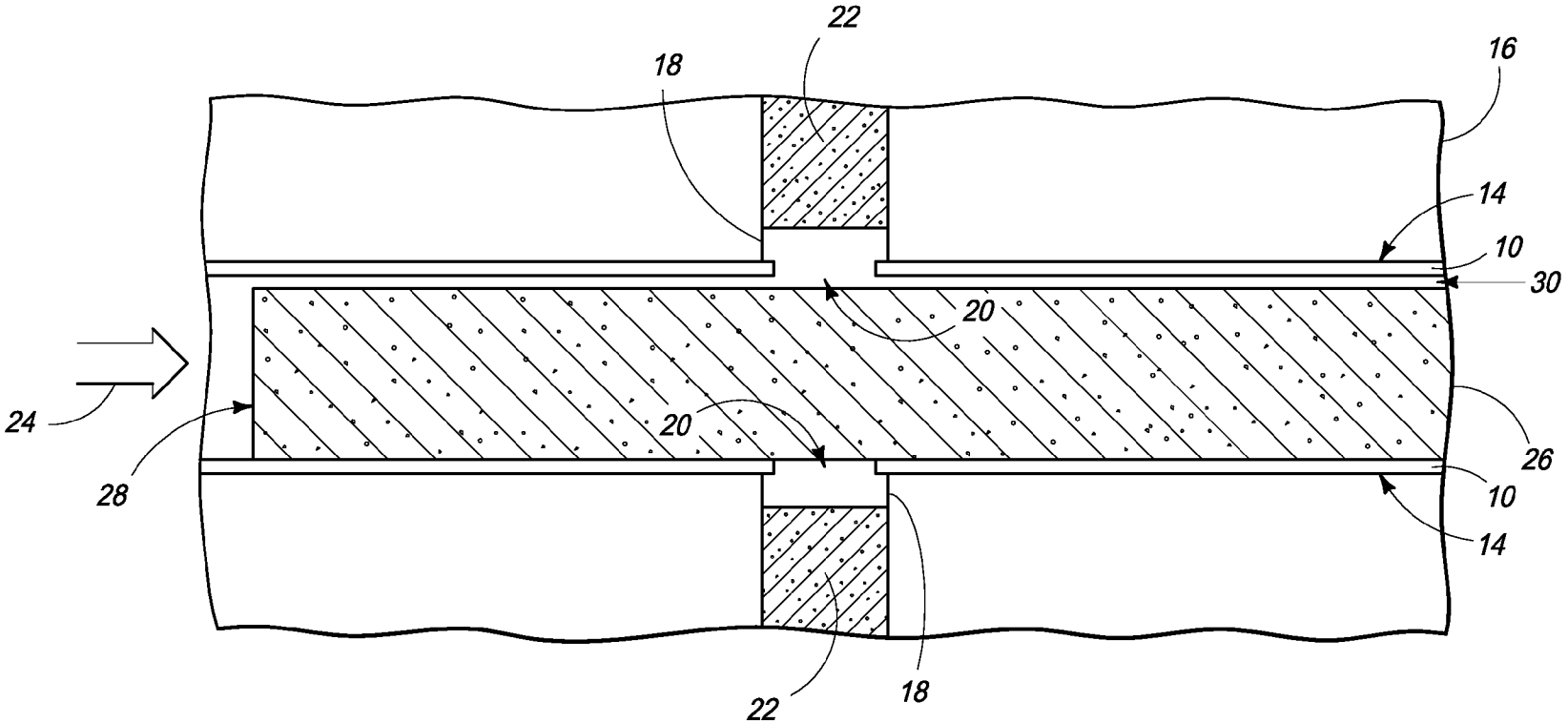
Figure 3:
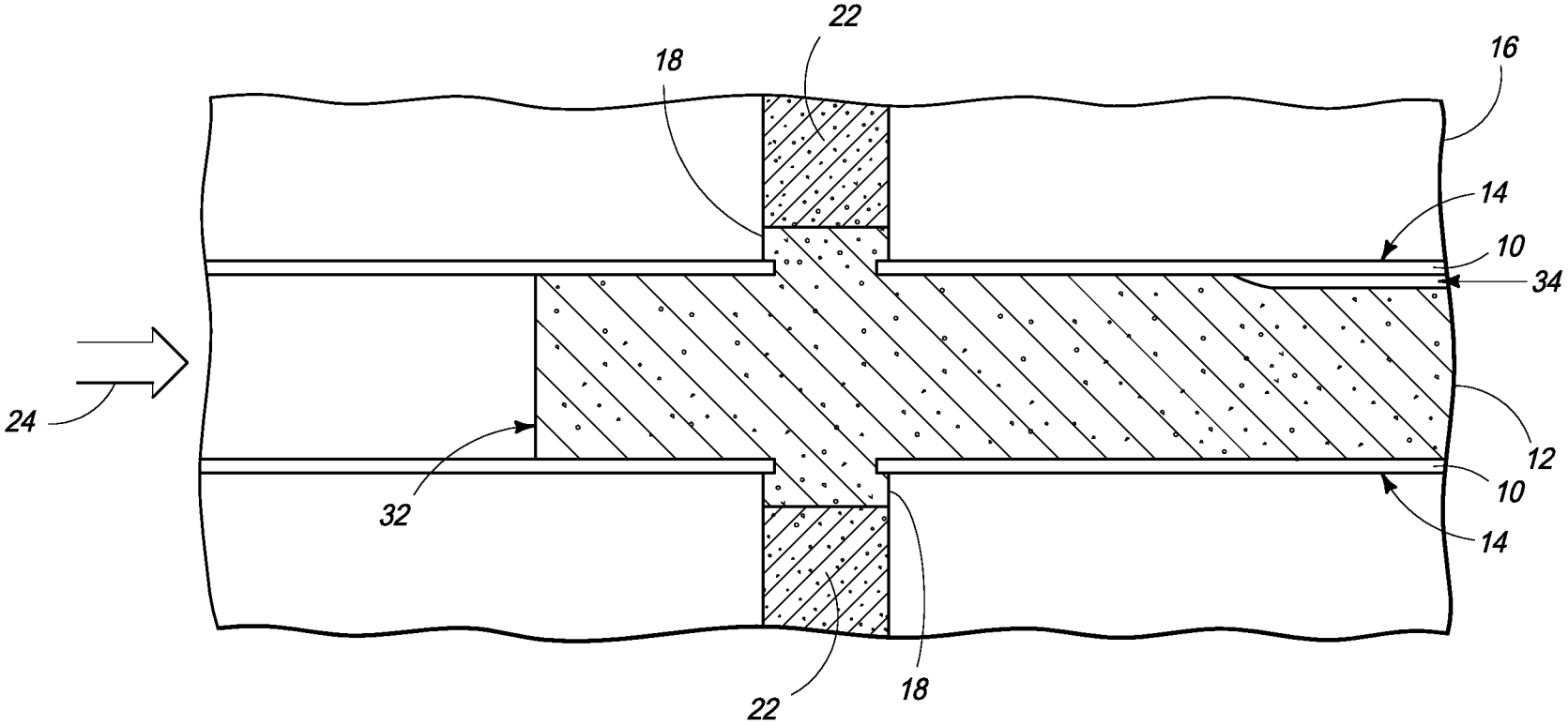

FIGS. 1-3 show cross-sectional, schematic views of a portion of a length of well casing 10 at different stages in a process of forming a plug 12 according to one embodiment. Well casing 10 is horizontally positioned in a well bore 14 through a subterranean formation 16 and has perforations 20 through well casing 10. FIG. 1 shows a view after fracturing of formation 16 through perforations 20 to produce fractures 18 and after lodging of proppant 22 in fractures 18. Passage of materials from a well head (not shown) into well casing 10 is in the direction indicated by flow 24. Well casing 10 may have additional perforations downhole from perforations 20 through which additional fractures were formed during the same fracturing stage that produced fractures 18.

FIG. 2 shows a view after placement of a slurry 26 in well casing 10 over perforations 20. Slurry 26 includes a transitory binder and filler in a liquid carrier, the filler containing particles of a solid material. FIG. 2 also shows that fractures 18 have narrowed compared to FIG. 1 as a result of shutting down fracturing pumps (not shown) after fracturing and a delay white preparing slurry 26 for placement in well casing 10. Proppant 22 has compressed closer to perforations 22 with the narrowing of fractures 18. A trailing edge 28 of slurry 26 is placed uphole from perforations 22 between perforations 22 and second perforations (not shown) yet to be opened further uphole from perforations 22 and separated from perforations 22 through which formation 16 was fractured during the preceding fracturing stage.

After placement of slurry 26, it is conceivable that some settling of filler and/or transitory binder in the liquid carrier may occur such that a gap 30 results between well casing 10 and the materials of slurry 26. The extent of setting pursuant to Stokes' Law and/or other principles may depend on characteristics of the materials used, such as, specific gravity of the carrier compared to specific gravity of the filler and/or transitory binder and particle sizes, the passage of time, etc. Misselbrook '556 mentioned above describes some related considerations intended to reduce settling in slurries used to form well plugs. Reducing the depth of gap 30 may help with subsequently forming a plug.

Once slurry 26 is placed, second perforations may be opened preparatory to fracturing the formation through the second perforations. FIG. 3 shows a view after injection of fracturing fluid for the fracturing through the second perforations. The materials of slurry 26 have shifted to form plug 12 over and through perforations 20 with the transitory binder and filler. Plug 12 has a trailing edge 12 that has shifted downhole as the materials of slurry 26 compressed into gap 30 and through perforations 20.

Notably, FIG. 3 shows a gap 34 that remains as a residual of gap 30 along a portion of slurry 26 that did not compress sufficiently to fill gap 30. It is conceivable that an entire length of slurry 26 where placed along well casing 10 may compress to till gap 30. However, so long as a trailing edge 32 does not shift past perforations 20 and a sufficient length of slurry 26 compresses to isolate perforations 20 during subsequent fracturing, plug 12 may provide the effect of focusing fracturing on second perforations uphole from plug 12.

The transitory binder included in plug 12 may releasably engage the Idler particles with one another sufficiently for plug 12 to withstand an applied pressure of hydraulic fracturing without loss of integrity of the plug. Even though slippage between particles may occur in plug 12 during application of fracturing pressures such that trailing edge 32 shifts further downhole, plug integrity may be maintained. The transitory binder may further exhibit the characteristic of allowing the filler particles to disengage into a flow cleanout fluid applied to the filler and transitory binder, resulting in loss of integrity of the plug after fracturing is complete and the well is being prepared for production. Accordingly, the plug may exhibit the properties of withstanding fracturing pressures, even when slippage occurs, while being easily re-slurried under a flow of liquid.

The transitory binder may include proppant made of resin-coated walnut shell particles or lightweight ceramic particles having specific gravity between about 1.25 to 1.75, for example, LITEPROP 125 or 175 ultra-lightweight proppant, or made of heat-treated thermoplastic nanocomposite particles having a specific gravity of about 1.05, for example, LITEPROP 108 ultra-lightweight proppant, or proppant flow back additive made of deformable resin particles, for example FLEXSAND, all available from Baker Hughes Inc. of Houston, Tex. The transitory binder may instead or additionally include fibrous materials. Examples of fibrous materials may be made of polypropylene chopped fiber having a specific gravity of about 0.91 to 0.93, for example RI-FIBER or FIBER ULTRA, both available from Baker Hughes Inc. Wood and/or nylon fibers may also be useful atone or in combination with the listed materials. Additional possibilities include organic material, which might be ground or shredded, of varying shape, such as cottonseed hulls, nut shells, or other inexpensive material with a specific gravity less than 2.0 configured to occupy volume in a plug.

Another transitory binder includes uintahite natural asphalt having a specific gravity of about 1.07, for example, GILSONITE, available from American Gilsonite Company of Vernal, Utah and known for use as a bridging additive in well cementing processes. A further transitory binder includes cellophane flake having a specific gravity of about 1.45, for example, CELLO FLAKE, available from Petrochem USA, Inc. of Opa-Locka, Fla. and known for use as a lost-circulation additive in well cementing processes.

Ground coat particles having a specific gravity of about 1.30, for example KOL SEAL, shredded plastic or rubber particles having a specific gravity of about 0.95 to 1.4, for example MAX SEAL, and amorphous volcanic glass particles (perlite) having a specific gravity of about 0.1 to 0.4, for example PERFALITE, all available from Baker Hughes Inc. may also be suitable. Liquids, resins, and surfactants capable of imparting a cohesive characteristic to the filler may further be suitable. Product categories that might provide suitable transitory binders include lost circulation additives for well cementing processes and proppant consolidation, proppant bridging, or proppant flow back materials for fracture stimulation processes. Particle sizes may range from about 325 mesh to about 6 mesh.

Accordingly, a hydraulic fracturing method may include injecting fracturing fluid containing proppant through a substantially horizontal well casing positioned in a well bore without any placement apparatus present in the substantially horizontal well casing, the substantially horizontal well casing having first perforations through the well casing to a subterranean formation adjacent the well bore. The formation is hydraulically fractured through the first perforations using the fracturing fluid without any placement apparatus present in the substantially horizontal well casing, the proppant lodging in fractures in the formation produced by the hydraulic fracturing.

After the fracturing, transitory binder and filler are added to the fracturing fluid or a different composition of fluid, the transitory binder having a composition different from the proppant and the filler containing particles of a solid material. The transitory binder comprises fibrous materials, polypropylene fiber, wood fiber, nylon fiber, uintahite natural asphalt, cellophane flake, coal particles, plastic or rubber particles, perlite, cottonseed hull particles, nut shell particles, or combinations thereof or other materials discussed above. The method includes injecting the fluid containing the transitory binder and filler into the substantially horizontal well casing without any placement apparatus present in the substantially horizontal well casing. The transitory binder and the filler are placed over the first perforations.

Using a placement apparatus, second perforations are formed through the well casing to the formation adjacent the well bore, the second perforations being separated from the first perforations. The method includes injecting additional fracturing fluid through the substantially horizontal well casing and forming a plug over and through the first perforations with the transitory binder and filler, the transitory binder releasably engaging the filler particles with one another sufficiently for the plug to withstand an applied pressure of hydraulic fracturing without loss of integrity of the plug.

After plugging the first perforations, the formation is hydraulically fractured through the second perforations, the particles of the solid material providing a majority of the mass of the plug and have a specific gravity of 2.0 or greater. The transitory binder contains particles of another solid material providing a minority of the mass of the plug and having a specific gravity of less than 2.0 The method includes applying a flow of cleanout fluid to the filler and transitory binder sufficient to disengage the transitory binder and expose the first perforations. The transitory binder exhibits the characteristic of allowing the filler particles to disengage into the cleanout fluid, resulting in loss of integrity of the plug.

As may be appreciated from the disclosure herein, a well casing plug may include a filler containing particles of a solid material providing a majority of the mass of the plug and having a specific gravity of 2.0 or greater. The plug further includes a transitory binder that releasably engages the filler particles with one another sufficiently for the plug to withstand an applied pressure of hydraulic fracturing without loss of integrity of the plug. The transitory binder exhibits the characteristic of allowing the filler particles to disengage into a flow of cleanout fluid applied to the filter and transitory binder, resulting in loss of integrity of the plug. The plug resides over and through perforations through a substantially horizontal well casing that is positioned in a well bore.

Determining the process parameters used to place the transitory binder and the filler over the perforations may involve calculations using physical dimensions and properties of the well casing and fracturing apparatus. Volume displacement from a flow meter, such as an in-line densitometer, to the perforations may be calculated based on physical dimensions of well casing and process piping with knowledge of the location where the perforations were formed. Distance to the perforations may be obtained from placement apparatus used to form the perforations, such as coiled tubing. Such calculations reflect the volume of displacement fluid used to displace the slurry to the perforations. After calculating the volume of slurry to cover the perforations for given well casing dimensions, monitoring flow volume using the flow meter may indicate when the slurry reaches and then is placed over the desired perforations. The Example below may be instructive in understanding the process.

EXAMPLE

Seismic activity in a pair of horizontal wells in a shale formation collapsed both casing strings to a point of reduced inner diameter such that mechanical plugs could no longer be run through the well casing for isolation between stimulation fracturing stages. Without isolation following each fracturing stage, the wells could not be stimulated along their entire lateral lengths, which was expected to significantly impact well production.

The known procedure of running perforating guns on coiled tubing along with sand plugs between fracturing stages was modified to running perforating guns alone and placing the sand plugs without the coiled tubing in the horizontal well casing. Sand plug volume sufficient to isolate each stage, based on perforation spacing and casing size, was calculated to use 5,000 pounds (lb.) of solid material. The solid material for the plug included a uniform mixture of 70 weight percent (wt. %) 100 mesh sand and 30 wt. % 14/30 mesh FLEXSAND MSE (proppant flow back additive made of deformable resin particles).

The fracture design for the two wells was calculated to include a combined total of 18 fracture stages and 16 sand plugs. After the first fracture stage in each well, the well casing was flushed and the fracturing pumps shut down. Instantaneous shut down pressures, flow rates and surface treating pressures were noted. A blender hopper was loaded with 5,000 lbs. of the indicated solid material mixture and one fracturing pump closest to the blender was isolated from the fracturing manifold trailer to pump the sand plugs. The blender mixed the solid material with fracturing fluid (omitting any friction reducer or gel) achieving a 14 lb. per gallon slum; that was pumped to the wellhead at 5 to 10 barrels per minute (bpm). Other fracturing pumps were then brought online and the slurry was displaced to the well casing perforations of the first fracture stage. Relying on the calculated well bore volume up to the first stage perforations compared to the volume of fracturing fluid displacing the shiny down the well bore, pumping rate was slowed to 1 bpm when the leading edge of the slurry reached the first perforations and as the plug was set across the perforated interval, and then the pumps were shut down.

Since the fractures in the shale formation were still open during the slurry placement operation, no pressure increases were identified indicating that plugs had set solidly during placement. However, coiled tubing was then rigged-up to perforate the well casing for the next stage. Each time during the pumping of the next stage treatments, instantaneous shut down pressures, flow rates and surface treating pressures were different than had been observed during the preceding stage flushes. A higher breakdown pressure for the next stage indicated setting of the sand plug.

After completing treatment of each well bore, the sand plugs were washed out with coiled tubing and the location of each sand plug was identified within a short distance of where it was placed. That is, there was little slippage and/or compression during the fracturing stages following slurry placement and the placement calculations based on well casing volume were effective.

Although various embodiments have been shown and described, the present disclosure is not so limited and will be understood to include all such modifications and variations as would be apparent to one skilled in the art.

TABLE OF REFERENCE NUMERALS FOR FIGS. 1-3

10 well casing
12 plug
14 well bore
16 formation
18 fractures
20 perforations
22 proppant
24 flow
26 slurry
28 trailing edge
30 gap
32 trailing edge
34 gap

What is claimed is:

1. A hydraulic fracturing method comprising:

injecting fracturing fluid containing proppant through a substantially horizontal well casing positioned in a well bore, the substantially horizontal well casing having first perforations through the well casing to a subterranean formation adjacent the well bore;

hydraulically fracturing the formation through the first perforations using the fracturing fluid, the proppant lodging in fractures in the formation produced by the hydraulic fracturing;

after the fracturing, providing transitory binder and filler in a liquid carrier, the filler containing particles of a solid material;

injecting the liquid carrier containing the transitory binder and filler into the substantially horizontal well casing without any placement apparatus present in the substantially horizontal well casing;

placing the transitory binder and the filler over the first perforations;

using a placement apparatus, opening second perforations through the well casing to the formation adjacent the well bore, the second perforations being separated from the first perforations;

injecting additional fracturing fluid through the substantially horizontal well casing and forming a plug over and through the first perforations with the transitory binder and filler;

after plugging the first perforations, hydraulically fracturing the formation through the second perforations using the additional fracturing fluid; and applying a flow of cleanout fluid to the plug sufficient to disengage the transitory binder and expose the first perforations.

2. The method of claim 1 wherein injecting the fracturing fluid containing proppant occurs without any placement apparatus present in the substantially horizontal well casing.

3. The method of claim 1 wherein hydraulically fracturing the formation through the first perforations using the fracturing fluid occurs without any placement apparatus present in the substantially horizontal well casing.

4. The method of claim 1 wherein the proppant and the filler have a same composition and the liquid carrier is the fracturing fluid.

5. The method of claim 1 wherein the proppant and the transitory binder have a different composition.

6. The method of claim 1 wherein the particles of the solid material provide a majority of the mass of the plug and have a specific gravity of 2.0 or greater.

7. The method of claim 1 wherein the transitory binder comprises particles of a solid material different from the filler.

8. The method of claim 1 wherein the transitory binder comprises particles of another solid material providing a minority of the mass of the plug and having a specific gravity of less than 2.0.

9. The method of claim 1 wherein the transitory binder releasably engages the filler particles with one another sufficiently for the plug to withstand an applied pressure of the hydraulic fracturing through the second perforations without loss of integrity of the plug, the transitory binder exhibiting the characteristic of allowing the filler particles to disengage into the cleanout fluid, resulting in loss of integrity of the plug.

10. The method of claim 1 further comprising repeating the method multiple times in a manner that forms an additional plug over the second perforations and subsequent plugs over subsequent perforations and that hydraulically fractures the formation through the subsequent perforations before the application of the flow of cleanout fluid, wherein the flow of cleanout fluid is applied to the plug, the additional plug, and the subsequent plugs sufficient to disengage the transitory binder and expose the first, the second, and the subsequent perforations.

11. The method of claim 1 wherein the transitory binder releasably engages the filler particles with one another without loss of integrity by breaching of the plug even when slippage between particles occurs.

12. The method of claim 1 wherein the transitory binder comprises fibrous materials, polypropylene fiber, wood fiber, nylon fiber, uintahite natural asphalt, cellophane flake, coal particles, plastic or rubber particles, perlite, cottonseed hull particles, or combinations thereof having particle sizes from about 325 mesh to about 6 mesh.

13. The method of claim 1 wherein the placement apparatus comprises coiled tubing, a wireline, or a jointed pipe string.

14. A hydraulic fracturing method comprising:

injecting fracturing fluid containing proppant through a substantially horizontal well casing positioned in a well bore without any placement apparatus present in the substantially horizontal well casing, the substantially horizontal well casing having first perforations through the well casing to a subterranean formation adjacent the well bore;

hydraulically fracturing the formation through the first perforations using the fracturing fluid without any placement apparatus present in the substantially horizontal well casing, the proppant lodging in fractures in the formation produced by the hydraulic fracturing;

after the fracturing, adding a transitory binder and a filler to the fracturing fluid or a different composition of fluid, the transitory binder having a composition different from the proppant and the filler containing particles of a solid material, the transitory binder comprising fibrous materials, polypropylene fiber, wood fiber, nylon fiber, uintahite natural asphalt, cellophane flake, coal particles, plastic or rubber particles, perlite, cottonseed hull particles, or combinations thereof;

injecting the fluid containing the transitory binder and filler into the substantially horizontal well casing without any placement apparatus present in the substantially horizontal well casing;

placing the transitory binder and the filler over the first perforations;

using a placement apparatus, forming second perforations through the well casing to the formation adjacent the well bore, the second perforations being separated from the first perforations;

injecting additional fracturing fluid through the substantially horizontal well casing and forming a plug over and through the first perforations with the transitory binder and filler, the transitory binder releasably engaging the filler particles with one another sufficiently for the plug to withstand an applied pressure of hydraulic fracturing through the second perforations without loss of integrity of the plug;

after plugging the first perforations, hydraulically fracturing the formation through the second perforations, the particles of the solid material providing a majority of the mass of the plug and have a specific gravity of 2.0 or greater and the transitory binder containing particles of another solid material providing a minority of the mass of the plug and having a specific gravity of less than 2; and applying a flow of cleanout fluid to the filler and transitory binder sufficient to disengage the transitory binder and expose the first perforations, the transitory binder exhibiting the characteristic of allowing the filler particles to disengage into the cleanout fluid, resulting in loss of integrity of the plug.

15. A well casing plug comprising:

a filler containing particles of a solid material providing a majority of the mass of the plug and having a specific gravity of 2.0 or greater;

a transitory binder that releasably engages the filler particles with one another sufficiently for the plug to withstand an applied pressure of hydraulic fracturing without loss of integrity of the plug, the transitory binder exhibiting the characteristic of allowing the filler particles to disengage into a flow of cleanout fluid applied to the filler and transitory binder, resulting in loss of integrity of the plug; and wherein the plug resides over and through perforations through a substantially horizontal well casing that is positioned in a well bore.

16. The plug of claim 15 wherein the transitory binder comprises particles of a solid material different from the filler.

17. The plug of claim 15 wherein the transitory binder comprises particles of another solid material providing a minority of the mass of the plug and having a specific gravity of less than 2.

18. The plug of claim 15 wherein the transitory binder releasably engages the filler particles with one another without loss of integrity by breaching of the plug even when slippage between particles occurs.

19. The plug of claim 15 wherein the transitory binder is a deformable solid.

20. The plug of claim 15 wherein the transitory binder is water insoluble.

21. The plug of claim 15 wherein the transitory binder comprises a liquid.

22. The plug of claim 15 wherein the transitory binder comprises fibrous materials, polypropylene fiber, wood fiber, nylon fiber, uintahite natural asphalt, cellophane flake, coal particles, plastic or rubber particles, perlite, cottonseed hull particles, or combinations thereof having particle sizes from about 325 mesh to about 6 mesh.

* * * * *